US010315741B2

(12) United States Patent
Kondo et al.

(10) Patent No.: US 10,315,741 B2
(45) Date of Patent: Jun. 11, 2019

(54) UNDERWATER PROPULSION APPARATUS AND UNDERWATER EXPLORATION APPARATUS

(71) Applicant: NATIONAL UNIVERSITY CORPORATION TOKYO UNIVERSITY OF MARINE SCIENCE AND TECHNOLOGY, Tokyo (JP)

(72) Inventors: Hayato Kondo, Tokyo (JP); Masahiro Osakabe, Tokyo (JP)

(73) Assignee: National University Corporation Tokyo University Of Marine Science And Technology, Tokyo (JP)

( * ) Notice: Subject to any disclaimer, the term of this patent is extended or adjusted under 35 U.S.C. 154(b) by 0 days.

(21) Appl. No.: 15/516,669

(22) PCT Filed: Oct. 2, 2015

(86) PCT No.: PCT/JP2015/078083
§ 371 (c)(1),
(2) Date: Jul. 26, 2017

(87) PCT Pub. No.: WO2016/052737
PCT Pub. Date: Apr. 7, 2016

(65) Prior Publication Data

US 2017/0334534 A1 Nov. 23, 2017

(30) Foreign Application Priority Data

Oct. 3, 2014 (JP) ..... 2014-205122

(51) Int. Cl.
*B63G 8/14* (2006.01)
*B63H 11/08* (2006.01)
(Continued)

(52) U.S. Cl.
CPC ..... *B63G 8/14* (2013.01); *B63H 11/08* (2013.01); *B63H 11/103* (2013.01); *B63H 11/107* (2013.01)

(58) Field of Classification Search
CPC ... B63H 11/00; B63H 2011/008; B63H 11/02; B63H 11/04; B63H 11/08; B63H 11/10;
(Continued)

(56) References Cited

U.S. PATENT DOCUMENTS 114,637 A * 5/1871 Beidler ..... B63H 25/46 440/40
2,330,674 A * 9/1943 Briggs ..... B63G 8/16 114/151
(Continued)

FOREIGN PATENT DOCUMENTS

GB 739315 A 10/1955
JP U 63-134896 U 9/1988
(Continued)

OTHER PUBLICATIONS

International Preliminary Report on Patentability corresponding to international application No. PCT/JP2015/078083 dated Apr. 13, 2017 (English translation).
(Continued)

*Primary Examiner* — Ajay Vasudeva
(74) *Attorney, Agent, or Firm* — Marshall, Gerstein & Borun LLP

(57) ABSTRACT

An underwater propulsion apparatus 1 according to an embodiment includes a main body 2 having a conical tail portion, a channel 4 having an inlet 6 in the outer circumferential surface of the main body 2 and a nozzle 7 on the side downstream of the inlet 6 and in the tail portion, at least one pump 3 having an impeller 5 provided in the channel 4, a diffuser 8 attached to the main body 2 so as to surround the
(Continued)

outer circumference of the nozzle 7, and a plurality of direction control wings 9 attached to the outer surface of the main body 2 and located in positions downstream of the nozzle 7 and close thereto, each of the plurality of direction control wings 9 having an upstream end pivotally supported by the main body 2.

12 Claims, 10 Drawing Sheets

(51) Int. Cl.
*B63H 11/103* (2006.01)
*B63H 11/107* (2006.01)

(58) Field of Classification Search
CPC ... B63H 11/101; B63H 11/102; B63H 11/103; B63H 11/107; B63H 11/11; B63H 11/113; B63H 11/117; B63H 25/44; B63H 25/46; B63G 8/14; B63G 8/16; B63G 8/18
See application file for complete search history.

(56) References Cited

U.S. PATENT DOCUMENTS

| | | | | | |
|---|---|---|---|---|---|
| 3,150,625 | A * | 9/1964 | Brooks | B63H 25/46 | 114/20.1 |
| 3,182,623 | A * | 5/1965 | Lehmann | B63H 11/08 | 114/332 |
| 3,256,849 | A * | 6/1966 | Lehmann | B63G 8/16 | 114/151 |
| 3,447,324 | A | 6/1969 | French | | |
| 3,575,127 | A * | 4/1971 | Wislicenus | B63G 8/08 | 114/20.2 |
| 3,678,689 | A | 7/1972 | Ishiwata | | |
| 3,797,447 | A * | 3/1974 | Stubblefield | B63H 11/103 | 114/151 |
| 4,648,322 | A * | 3/1987 | Heitz | B63H 25/12 | 102/411 |
| 5,574,246 | A * | 11/1996 | Meyers | B63G 8/08 | 114/20.2 |
| 6,926,567 | B1 | 8/2005 | Dai et al. | | |
| 6,932,013 | B1 * | 8/2005 | Shen | B63G 8/16 | 114/151 |
| 7,124,698 | B1 * | 10/2006 | Shen | B63G 8/16 | 114/151 |
| 7,241,193 | B2 | 7/2007 | Jordan | | |
| 2010/0237165 | A1 | 9/2010 | Krueger | | |

FOREIGN PATENT DOCUMENTS

| | | | |
|---|---|---|---|
| JP | 06-329086 | A | 11/1994 |
| JP | 07-179196 | A | 7/1995 |
| JP | 08-048295 | A | 2/1996 |
| JP | 2000-280981 | A | 10/2000 |
| JP | 2004-189122 | A | 7/2004 |
| JP | 2010-115971 | A | 5/2010 |

OTHER PUBLICATIONS

International Search Report corresponding to international application No. PCT/JP2015/078083 dated Dec. 8, 2015 (English translation).
Supplementary European Search Report for EP Application No. 15 84 7250, dated Apr. 26, 2018.
Japanese Office Action (English translation) for corresponding Japanese application No. 2014-205122, dated Aug. 31, 2018.
Office Action for corresponding European Patent Application No. EP 15 847 250.6, dated Dec. 19, 2018.

* cited by examiner (b)

(a)

(b)

(a)

UNDERWATER PROPULSION APPARATUS AND UNDERWATER EXPLORATION APPARATUS

CROSS-REFERENCE TO RELATED APPLICATIONS

The present application is the US National Phase of International Patent Application No. PCT/JP2015/078083, filed Oct. 2, 2015, which claims priority to Japanese Application No. 2014-205122, filed Oct. 3, 2014, each of which is incorporated by reference in its entirety.

TECHNICAL FIELD

The present invention relates to an underwater propulsion apparatus and an underwater exploration apparatus, and particularly to a pump-jet-driven underwater propulsion apparatus and an underwater exploration apparatus using the underwater propulsion apparatus.

BACKGROUND ART

An underwater exploration apparatus, such as an autonomous underwater vehicle (AUV), has been known as an underwater robot. A variety of microstructure sensors are incorporated in the underwater exploration apparatus. The underwater exploration apparatus is intended to be used, for example, to observe a marine ecosystem, such as the distribution of planktons.

CITATION LIST

Patent Literature

Patent Literature 1: Japanese Patent Laid-Open No. 8-48295

Patent Literature 2: Japanese Patent Laid-Open No. 2010-115971

Patent Literature 3: Japanese Patent Laid-Open No. 7-179196

SUMMARY OF INVENTION

Technical Problem

The underwater exploration apparatus of related art, however, has the following problems:

First of all, in the case of a propeller-driven underwater exploration apparatus, when a propeller attached to the exterior of an apparatus body rotates, the apparatus body undesirably vibrates, and water around the apparatus body is agitated. An observation target, such as planktons, is therefore disturbed. The propeller-driven method is therefore unsuitable for the observation.

On the other hand, in the case of a pump-jet-driven underwater exploration apparatus, the problem of vibration described above is relieved. In the case of pump-jet propulsion of related art, however, when the number of revolutions of an impeller decreases, the pressure of the blasted flow decreases, and it is therefore undesirably difficult to produce propulsion force necessary in low-speed operation.

Further, an underwater exploration apparatus in water is preferably capable of not only forward movement and pivotal movement but also backward movement, quick pivotal movement, deceleration, and other types of control.

It is, however, difficult for the underwater exploration apparatus of related art to perform fine attitude control.

The present invention has been made on the basis of the technical problems described above, and an object of the present invention is to provide an underwater propulsion apparatus and an underwater exploration apparatus producing a small amount of vibration and capable of fine attitude control.

Another object of the present invention is to provide an underwater propulsion apparatus and an underwater exploration apparatus capable of ensuring propulsion force necessary in low-speed operation.

Solution to Problem

An underwater propulsion apparatus according to the present invention includes a main body, at least one pump having a channel and an impeller provided in the channel, the channel having an inlet in an outer circumferential surface of the main body and a nozzle on a side downstream of the inlet and in a tail portion of the main body, and a plurality of direction control wings attached to an outer surface of the main body and located in positions downstream of the nozzle and close thereto, each of the plurality of direction control wings having an upstream end pivotally supported by the main body.

The underwater propulsion apparatus described above may further include a diffuser attached to the main body so as to surround an outer circumference of the nozzle.

In the underwater propulsion apparatus described above, the diffuser may be provided with a first entrained flow introducing channel that passes through the diffuser and introduces water flow flowing along an outer side of the diffuser into a propulsion channel sandwiched between the diffuser and the direction control wings.

In the underwater propulsion apparatus described above, an outer surface of a downstream end portion of the diffuser may be provided with a plurality of first entrained flow introducing grooves that extend from an upstream side toward a downstream side and have a depth that increases with distance toward the downstream side.

In the underwater propulsion apparatus described above, an edge portion upstream of the nozzle may be provided with a second entrained flow introducing channel that passes through the edge portion and introduces water flow flowing along an outer side of the main body into the channel and in a portion close to the nozzle.

In the underwater propulsion apparatus described above, an outer surface of an edge portion upstream of the nozzle may be provided with a plurality of second entrained flow introducing grooves that extend from an upstream side toward a downstream side and have a depth that increases with distance toward the downstream side.

In the underwater propulsion apparatus described above, the tail portion of the main body may have a conical shape with a head portion truncated.

An underwater exploration apparatus according to the present invention includes a hull having a stern, at least one pump having a channel and an impeller provided in the channel, the channel having an inlet in an outer circumferential surface of the hull and a nozzle on a side downstream of the inlet and in the stern, and a plurality of direction control wings attached to an outer surface of the hull and located in positions downstream of the nozzle and close thereto, each of the plurality of direction control wings having an upstream end pivotally supported by the hull.

The underwater exploration apparatus described above may further include a diffuser attached to the hull so as to surround an outer circumference of the nozzle.

In the underwater exploration apparatus described above, the diffuser may be provided with a first entrained flow introducing channel that passes through the diffuser and introduces water flow flowing along an outer side of the diffuser into a propulsion channel sandwiched between the diffuser and the direction control wings.

In the underwater exploration apparatus described above, an outer surface of a downstream end portion of the diffuser may be provided with a plurality of first entrained flow introducing grooves that extend from an upstream side toward a downstream side and have a depth that increases with distance toward the downstream side.

In the underwater exploration apparatus described above, an edge portion upstream of the nozzle may be provided with a second entrained flow introducing channel that passes through the edge portion and introduces water flow flowing along an outer side of the hull into the channel.

In the underwater exploration apparatus described above, an outer surface of an edge portion upstream of the nozzle may be provided with a plurality of second entrained flow introducing grooves that extend from an upstream side toward a downstream side and have a depth that increases with distance toward the downstream side.

In the underwater exploration apparatus described above, the stern of the hull may have a conical shape with a head portion truncated.

Advantageous Effects of Invention

The present invention can provide an underwater propulsion apparatus and an underwater exploration apparatus producing a small amount of vibration and capable of ensuring propulsion force necessary in low-speed operation and performing fine attitude control.

The present invention can further provide an underwater propulsion apparatus and an underwater exploration apparatus capable of ensuring propulsion force necessary in low-speed operation.

DESCRIPTION OF EMBODIMENT

Figure 1:
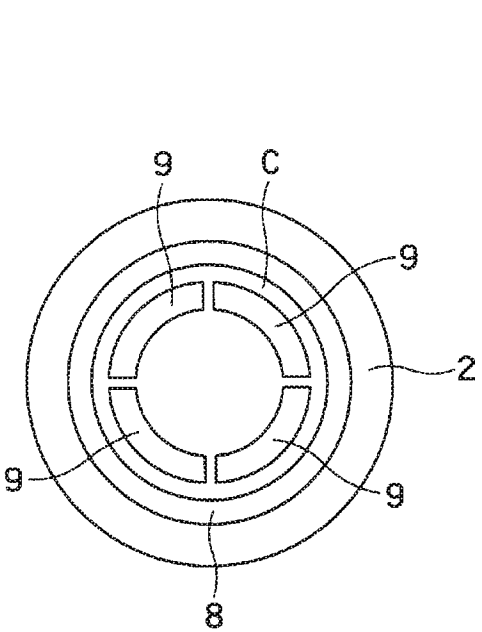
FIG. 1(*a*) is a side view of an underwater propulsion apparatus 1 according to an embodiment, and FIG. 1(*b*) is a rear view of the underwater propulsion apparatus 1.
Figure 1:
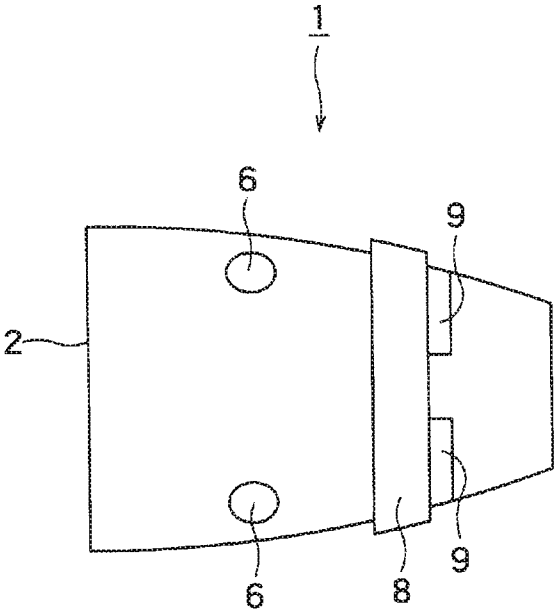

An embodiment according to the present invention will be described below with reference to the drawings. In the drawings, components having the function have the same reference character and no detailed description of the components having the same reference character will be repeated.

(Underwater Propulsion Apparatus)

Figure 2:
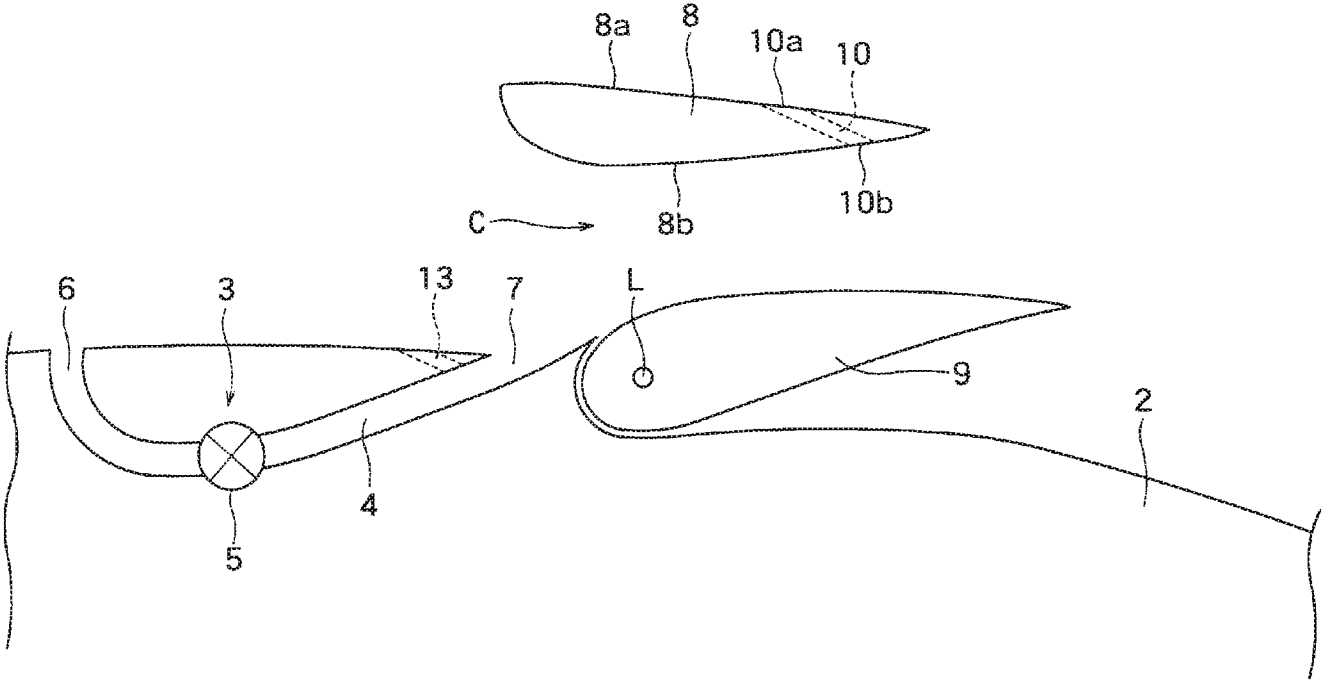
FIG. 2 is a partially enlarged cross-sectional view of the underwater propulsion apparatus 1.
Figure 3:
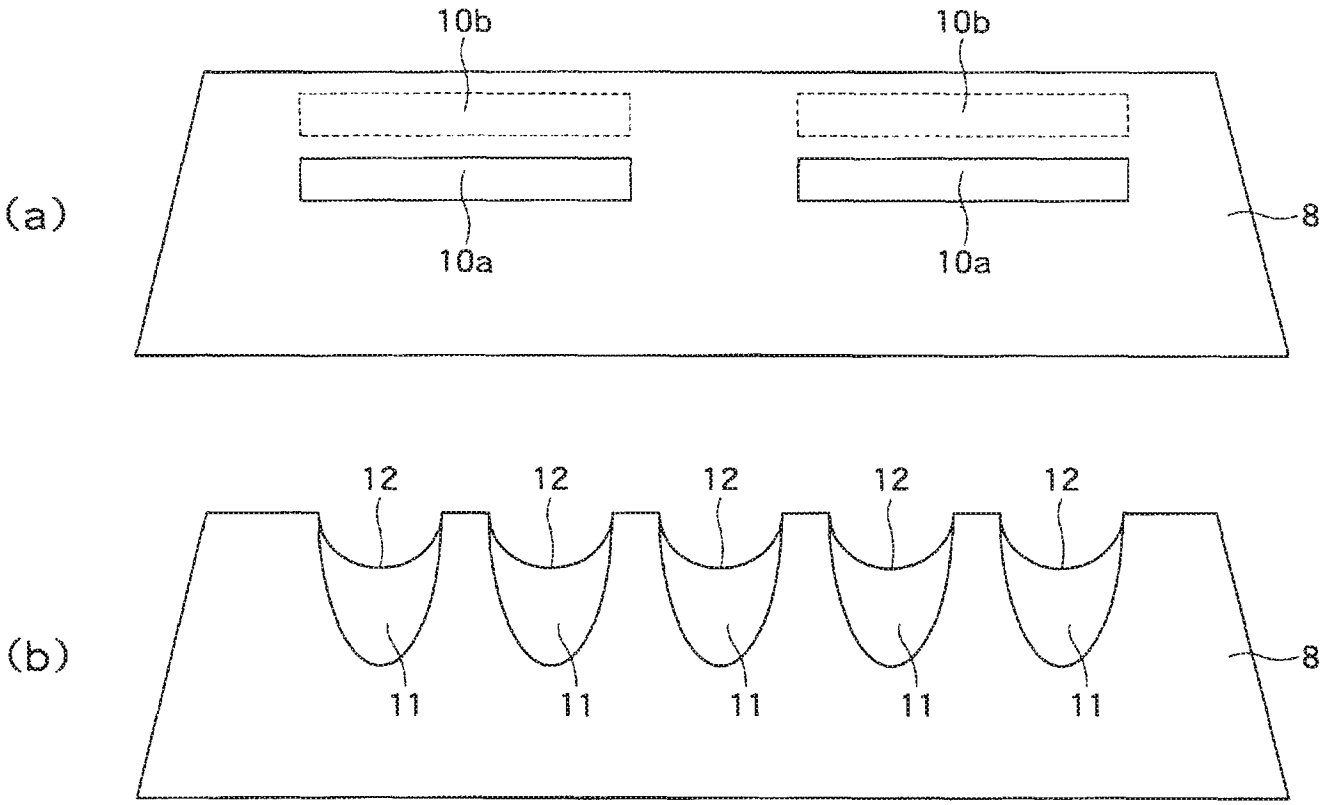
FIG. 3(*a*) is a side view of a diffuser 8 through which entrained flow introducing channels 10 are provided, and FIG. 3(*b*) is a side view of the diffuser 8 in which entrained flow introducing grooves 11 are provided.

The configuration of an underwater propulsion apparatus 1 according to an embodiment of the present invention will be described with reference to FIGS. 1 to 3. FIG. 1(*a*) is a side view of the underwater propulsion apparatus 1, and FIG. 1(*b*) is a rear view of the underwater propulsion apparatus 1. FIG. 2 is a partially enlarged cross-sectional view of the underwater propulsion apparatus 1 including a diffuser 8 and direction control wings 9. FIG. 3(*a*) is a side view of the diffuser 8, through which entrained flow introducing channels 10 are provided, and FIG. 3(*b*) is a side view of the diffuser 8, in which entrained flow introducing grooves 11 are provided.

The underwater propulsion apparatus 1 includes a main body 2, at least one pump 3, the diffuser 8, and a plurality of direction control wings 9, as shown in FIGS. 1(*a*), 1(*b*), and 2. The underwater propulsion apparatus 1 is, for example, attached to an underwater robot that acts in water and used to move the underwater robot and control the attitude thereof.

Each of the components of the underwater propulsion apparatus 1 will next be described in detail.

The main body 2 is so configured that at least a tail portion thereof has a conical shape, as shown in FIGS. 1(*a*) and 1(*b*). The tail portion of the main body 2 preferably has a conical shape with a head portion thereof truncated, as shown in FIG. 1(*a*). It is noted that the main body 2 does not necessarily have a conical shape and may, for example, have a cylindrical shape, a box-like shape, a prismatic shape, or a pyramidal shape.

Channels 4, through which sucked water flows, are provided in the main body 2 so as to pass therethrough, as shown in FIG. 2. Each of the channels 4 has an inlet 6 at one end thereof and a nozzle 7 at the other end thereof. The inlet 6 is provided in the outer circumferential surface of the main body. The nozzle 7 is provided on the side downstream of the inlet 6 and in the tail portion of the main body 2. For example, in the case where the tail portion of the main body 2 has a conical shape, the nozzles 7 each have an arcuate opening formed along the circumferential direction of the tail portion, and in the case where the tail portion of the main body 2 has a box-like shape, the nozzles 7 each has a rectangular opening and are formed along the circumferential direction in the four side surfaces of the tail portion. The nozzles 7 do not necessarily have an arcuate or rectangular shape and may, for example, have an elliptical shape or any other arbitrarily curved shape. The thus configured channels 4 each have the inlet 6 in the outer circumferential surface of the main body 2 and the nozzle 7 on the side downstream of the inlet 6 and in the tail portion of the main body.

Each of the pumps 3 has the channel 4 and an impeller 5 provided in the channel 4, as shown in FIG. 2. When the impeller 5 rotates at high speed, water is sucked via the inlet 6, and jet flow is discharged (blasted) via the nozzle 7. Employing the pump-jet-driven method using the pump 3 allows suppression of vibration of the main body 2 (vibration at low frequency ranging from 1 to 50 Hz, in particular) as compared with the propeller-driven method.

The pumps 3 are provided at a plurality of locations in the main body 2 in correspondence with the direction control wings 9. In this case, the inlets 6 and the nozzles 7 are provided at a plurality of locations on the outer circumferential surface of the main body 2 in correspondence with the number of pumps.

It is noted that only one pump 3 may instead be provided in the main body 2. In this case, one channel 4 branches off in a portion downstream of the impeller 5 toward the nozzles 7 provided in correspondence with the direction control wings 9.

The diffuser 8 is attached to the main body 2 so as to surround the outer circumference of the nozzles 7, as shown in FIGS. 1(*a*), 1(*b*), and 2. The diffuser 8 is provided in accordance with the outer circumferential shape of the tail portion of the main body 2. For example, in the case where the tail portion of the main body 2 has a conical shape, the diffuser 8 has a cylindrical shape, and in the case where the tail portion of the main body 2 has a box-like shape, the diffuser 8 has the shape of a rectangular tube. The diffuser 8 is fixed to the main body 2 via a plurality of columnar connectors (not shown) that link the main body 2 to the diffuser 8.

When the diffuser 8 is provided, the channel of water flow (peripheral flow) flowing around the underwater propulsion apparatus 1 narrows, resulting in an increase in the speed of the peripheral flow. Since the peripheral flow that flows at the higher speed is likely to be drawn by the jet flow blasted via the nozzles 7, the propulsion force can be increased.

The direction control wings 9 are provided at a plurality of locations, as shown in FIGS. 1(*a*) and 1(*b*). In the present embodiment, four direction control wings 9 are provided, as shown in FIG. 1(*b*). In the present invention, the number of direction control wings 9 is not limited to four, and two, three, or five or more direction control wings 9 may be provided.

Each of the direction control wings 9 is attached to the outer surface of the main body 2 and located in a position downstream of the nozzles 7 and close thereto in such a way that the direction control wing 9 follows the shape of the tail portion of the main body 2, as shown in FIGS. 1(*a*), 1(*b*), and 2. For example, in the case where the tail portion of the main body 2 has a conical shape, the direction control wings 9 are attached in an annular shape. In the case where the tail portion of the main body 2 has a box-like shape, the direction control wings 9 are attached to the four sides of the tail portion.

Each of the direction control wings 9 has an upstream end pivotally supported by the main body 2. In more detail, each of the direction control wings 9 is attached to the main body 2 so as to pivot around an axis of rotation L extending in the direction of a tangent to the outer circumference of the main body 2, as shown in FIG. 2. The direction control wings 9 are pivotable independently of one another.

When each of the direction control wings 9 pivot around the axis of rotation L, the flow direction of the jet flow and the peripheral flow (entrained flow) drawn by the jet flow can be controlled, as will be described later in detail.

Entrained flow introducing channels 10 are provided so as to pass through a lower end portion of the diffuser 8, as shown in FIG. 2. FIG. 3(*a*) is a side view of the diffuser 8 provided with the entrained flow introducing channels 10. Each of the entrained flow introducing channels 10 has an opening 10*a* provided in an outer surface 8*a* of the diffuser 8 and an opening 10*b* provided in an inner surface 8*b* of the diffuser 8. The opening 10*b* in the inner surface 8*b* is provided in a position downstream of the opening 10*a* in the outer surface 8*a*, as shown in FIGS. 2 and 3(*a*).

The entrained flow introducing channels 10 introduce the water flow flowing along the outer side of the diffuser 8 into propulsion channels C sandwiched between the diffuser 8 and the direction control wings 9. The propulsion force can therefore be further increased. The entrained flow introducing channels 10 also work when the underwater propulsion apparatus 1 quickly pivots or moves backward, as will be described later in detail.

The entrained flow introducing channels 10 are not necessarily provided in the lower end portion of the diffuser 8 and may be provided in another portion.

The diffuser 8 may instead be provided with a plurality of entrained flow introducing grooves 11, as shown in FIG. 3(*b*). In more detail, the plurality of entrained flow introducing grooves 11 may be provided in the outer surface 8*a* of a downstream end portion of the diffuser 8. The entrained flow introducing grooves 11 are so formed that they extend from the upstream side toward the downstream side and the depth of the grooves increases with distance toward the downstream side. The entrained flow introducing grooves 11 allow the water flow flowing along the outer side of the diffuser 8 to be introduced into the propulsion channels C so that the propulsion force increases, as in the case of the entrained flow introducing channels 10.

Cutouts 12 may further be formed in the downstream end portion of the diffuser 8 in accordance with the entrained flow introducing grooves 11, as shown in FIG. 3(*b*). The water flow in the propulsion channels C can therefore be discharged out of the diffuser 8 via the cutouts 12 with the direction control wings 9 being in contact with the downstream end portion of the diffuser 8 (see FIG. 9) when the underwater propulsion apparatus 1 quickly pivots or moves backward.

Entrained flow introducing channels 13 having the same shape as that of the entrained flow introducing channels 10 in the diffuser 8 may be provided in an edge portion upstream of the nozzles 7, as shown in FIG. 2. In more detail, entrained flow introducing channels 13, which introduce the water flow flowing along the outer side of the main body 2 into the channels 4 and in portions close to the nozzles 7, may be provided in the edge portion upstream of the nozzles 7 so as to pass through the edge portion.

Entrained flow introducing grooves having the same shape as that of the entrained flow introducing grooves 11 in the diffuser 8 shown in FIG. 3(*b*) may be provided. In more detail, a plurality of entrained flow introducing grooves that extend from the upstream side toward the downstream side and having a depth that increases with distance toward the downstream side may be provided in the exterior surfaces of edge portions upstream of the nozzles 7.

Providing the entrained flow introducing channels having the same shape as that of the entrained flow introducing channels 10 and the entrained flow introducing grooves having the same shape as that of the entrained flow introducing grooves 11 in the edge portions upstream of the nozzles 7 as described above allows the jet water flow blasted via the nozzles 7 to readily draw, in the vicinity of the nozzles 7, the water flow flowing along the outer side of the main body 2, whereby the propulsion force produced by the jet flow F can be increased.

Figure 5:
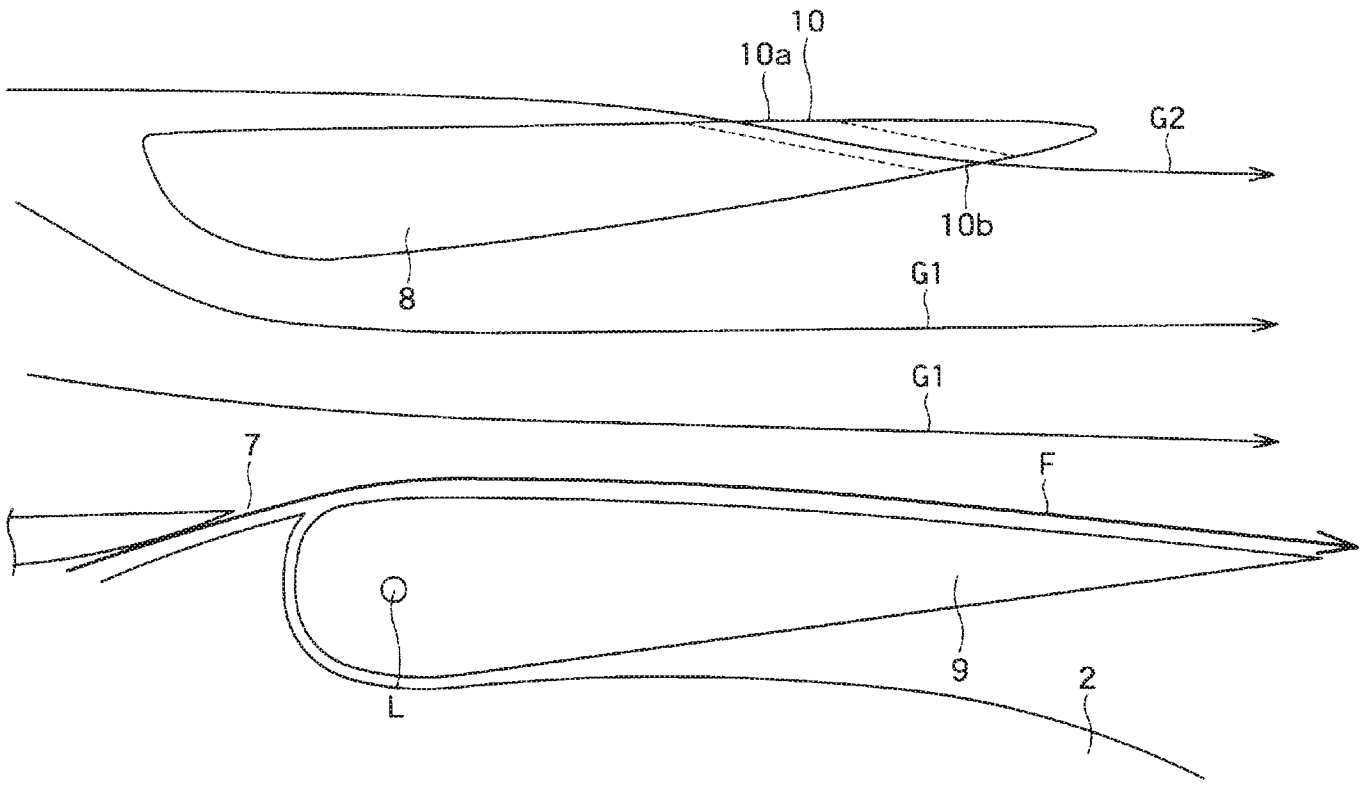
FIG. 5 is an enlarged view showing the diffuser 8, the direction control wing 9, and the path of the water flow in the forward movement.
Figure 6:
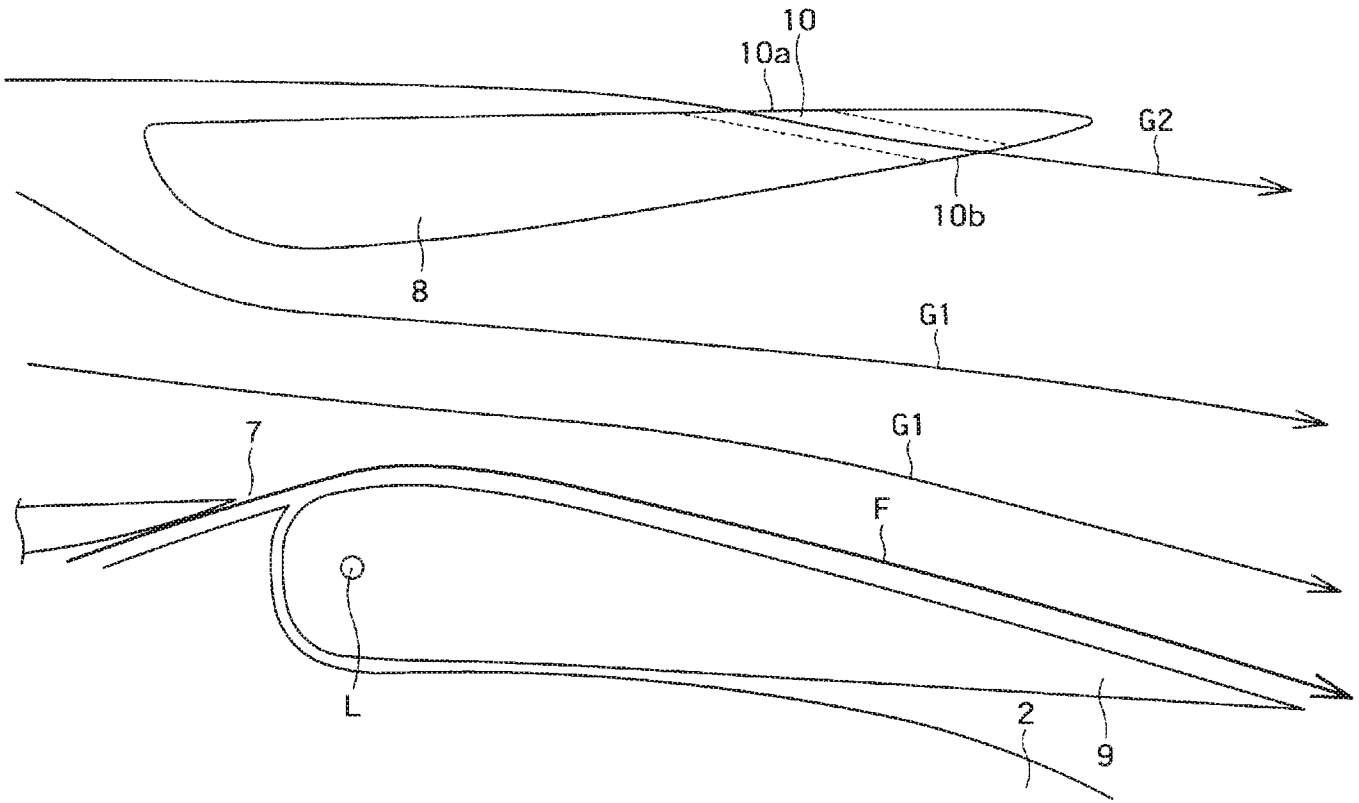
FIG. 6 is an enlarged view showing the diffuser 8, the direction control wing 9 on one side, and the path of the water flow in the pivotal movement.
Figure 7:
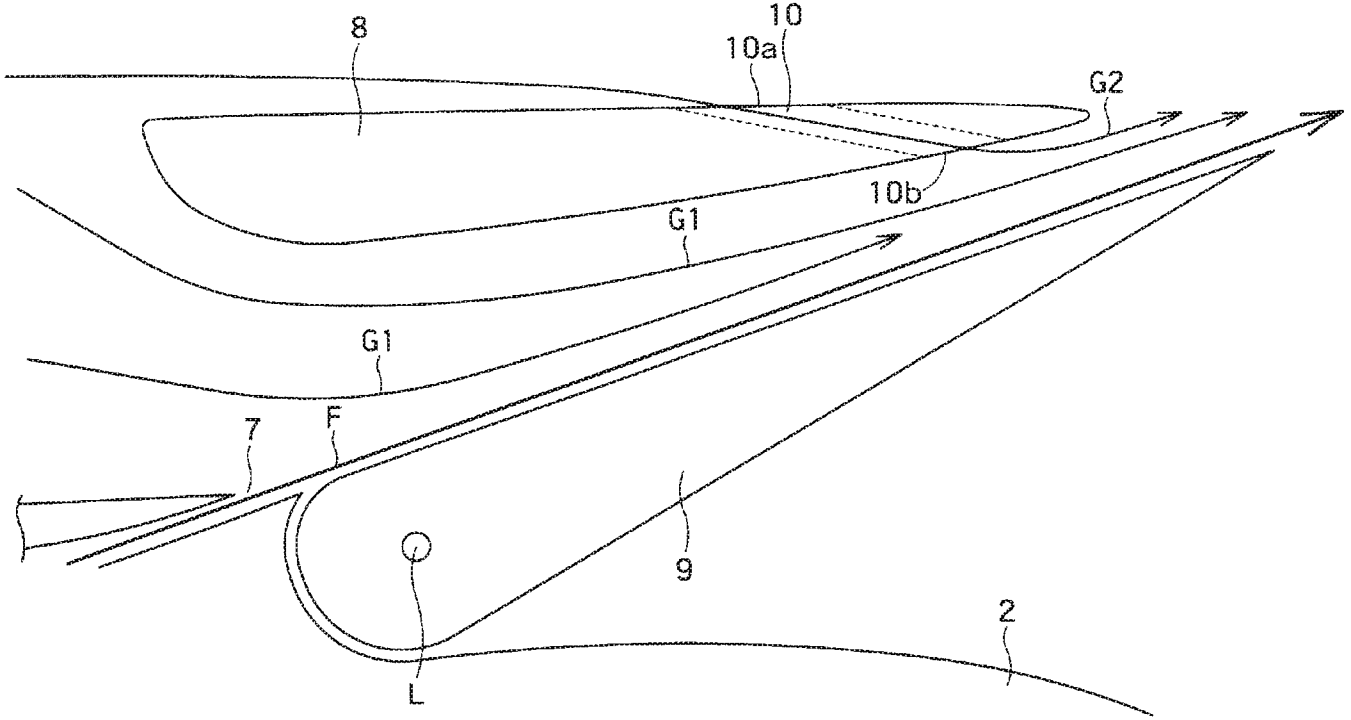
FIG. 7 is an enlarged view showing the diffuser 8, the direction control wing 9 on the other side, and the path of the water flow in the pivotal movement.

The principle of the propulsion of the underwater propulsion apparatus 1 will now be described with reference to FIG. 5. The jet flow F blasted via the nozzles 7 flows along the surfaces of the direction control wings 9 in accordance with a Coanda effect (effect that allows jet flow to flow along wall surface), as shown in FIG. 5. The jet flow F, which is high-speed flow, draws the peripheral flow flowing around the underwater propulsion apparatus 1 so that the drawn peripheral flow becomes entrained flow. In the present embodiment, since the diffuser 8 is provided, the peripheral flow flowing around the underwater propulsion apparatus 1 passes through the narrow propulsion channels C. The speed of the peripheral flow therefore increases, so that the peripheral flow is more likely to be drawn by the jet flow F, whereby the propulsion force increases.

Entrained flow G1 shown in FIG. 5 is peripheral flow flowing via the upstream end of the diffuser 8 into the propulsion channel C. Entrained flow G2 is peripheral flow passing along the outer side of the diffuser 8, passing through the entrained flow introducing channel 10, and flowing into the propulsion channel C. Water flow that is the sum of the jet flow F, the entrained flow G1, and the entrained flow G2 (hereinafter simply referred to as "summed flow") propels the underwater propulsion apparatus 1.

The summed flow flows along the surface of the direction control wing 9 and then flows along the surface of the head-truncated conical-shape tail portion of the main body 2. The summed flow having flowed along the tail portion forms backwater having a streamlined tail shape (that is, shape corresponding to head portion of cone) behind the main body 2. The backwater becomes an imaginary body of the main body 2 (rear end portion of main body 2). The tail portion of the main body 2 is therefore allowed to have the head-truncated conical shape, as shown in FIG. 1(*a*). The main body 2 can therefore be shortened by the length corresponding to the head of the cone. The length of the hull of an underwater exploration apparatus (hull 31, which will be described later) using the underwater propulsion apparatus 1 can therefore be increased, whereby the volume of the hull can be increased.

Control of the attitude of the underwater propulsion apparatus 1 having the configuration described above (forward movement, pivotal movement, quick pivotal movement, and backward movement) will next be described in detail.

<Forward Movement>

Figure 4:
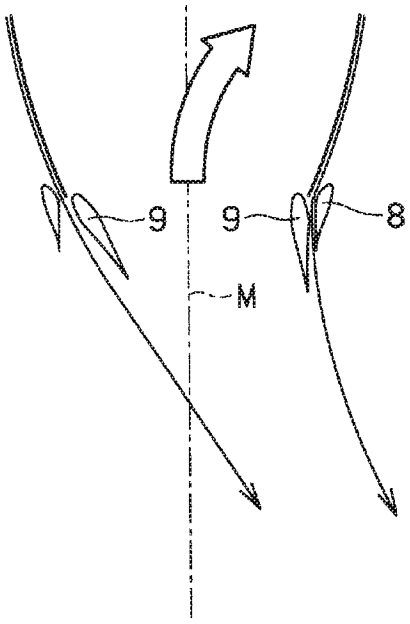
FIG. 4(*a*) shows the diffuser 8, direction control wings 9, and the pass of water flow in forward movement of the underwater propulsion apparatus 1, and FIG. 4(*b*) shows the diffuser 8, the direction control wings 9, and the pass of the water flow in pivotal movement of the underwater propulsion apparatus 1.
Figure 4:
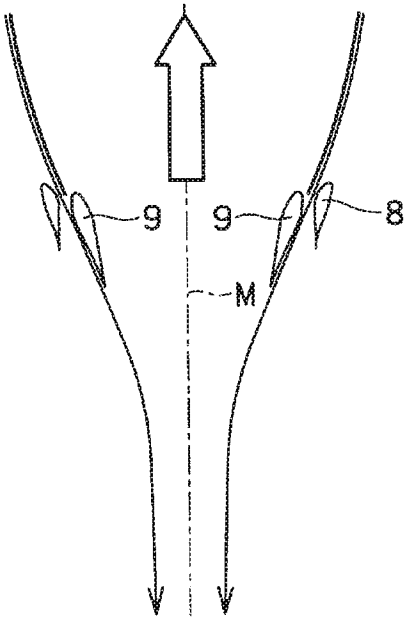

In the forward movement (rectilinear movement) of the underwater propulsion apparatus 1, the direction control wings 9 are positioned so as to have the same angle with respect to a center axis M of the main body 2, as shown in FIG. 4(*a*). Since the summed flow having passed along the direction control wings 9 flows symmetrically with respect to the center axis M toward the rear side of the main body, the underwater propulsion apparatus 1 rectilinearly moves.

Further, changing the angle of the direction control wings 9 allows change in the forward movement speed with the number of revolutions of each of the impellers 5 maintained at a fixed value.

<Pivotal Movement>

In pivotal movement (right-handed pivotal movement) of the underwater propulsion apparatus 1, the direction control wing 9 on one side (left in FIG. 4(*b*)) pivots around the axis of rotation L in such a way that the downstream end of the direction control wing 9 moves away from the diffuser 8 (that is, approaches main body 2), as shown in FIGS. 4(*b*) and 6. Negative moment of rotation is thus produced.

On the other hand, the direction control wing 9 on the other side (right in FIG. 4(*b*)) pivots around the axis of rotation L in such a way that the downstream end of the direction control wing 9 approaches the diffuser 8 (that is, moves away from main body 2), as shown in FIGS. 4(*b*) and 7. Positive moment of rotation is thus produced.

Since the summed flow (jet flow F, entrained flow G1, and entrained flow G2) having passed along the direction control wings 9 on both sides flows obliquely rearward and rightward with respect to the main body 2, as shown in FIG. 4(*b*), the underwater propulsion apparatus 1 pivots right-handed.

<Quick Pivotal Movement>

Figure 8:
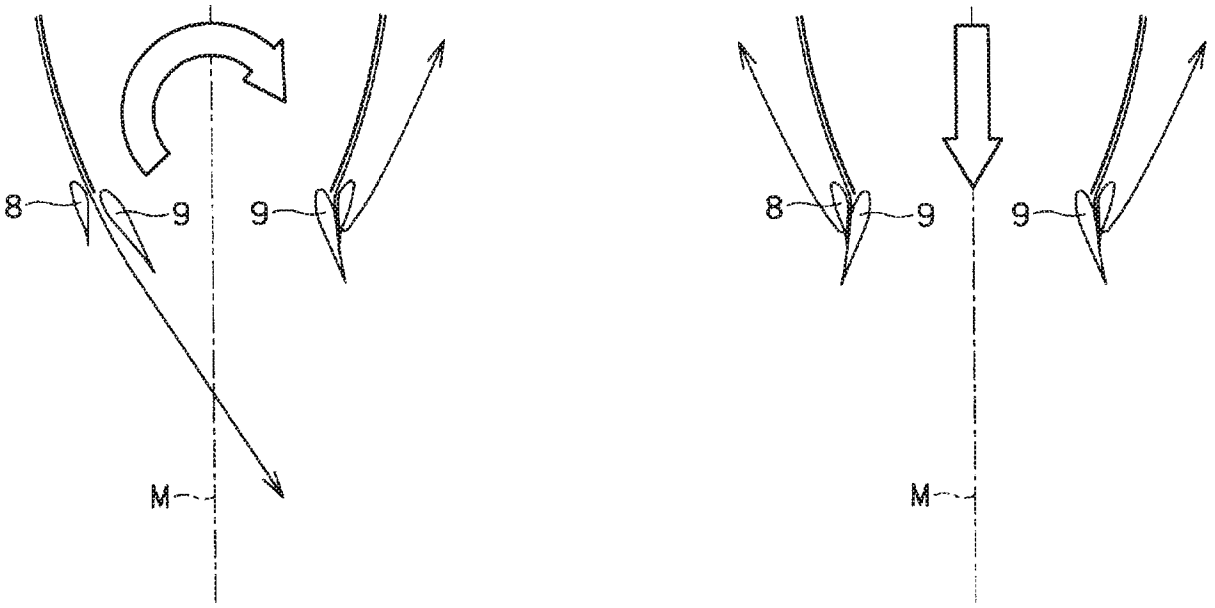
FIG. 8(*a*) shows the diffuser 8, the direction control wings 9, and the path of the water flow in quick pivotal movement, and FIG. 8(*b*) shows the diffuser 8, the direction control wings 9, and the path of the water flow in backward movement.

In quick pivotal movement (right-handed quick pivotal movement) of the underwater propulsion apparatus 1, the direction control wing 9 on one side (left in FIG. 8(*a*)) pivots around the axis of rotation L in such a way that the downstream end of the direction control wing 9 moves away from the diffuser 8 (that is, approaches main body 2), as shown in FIGS. 8(*a*) and 6. Negative moment of rotation is thus produced.

Figure 9:
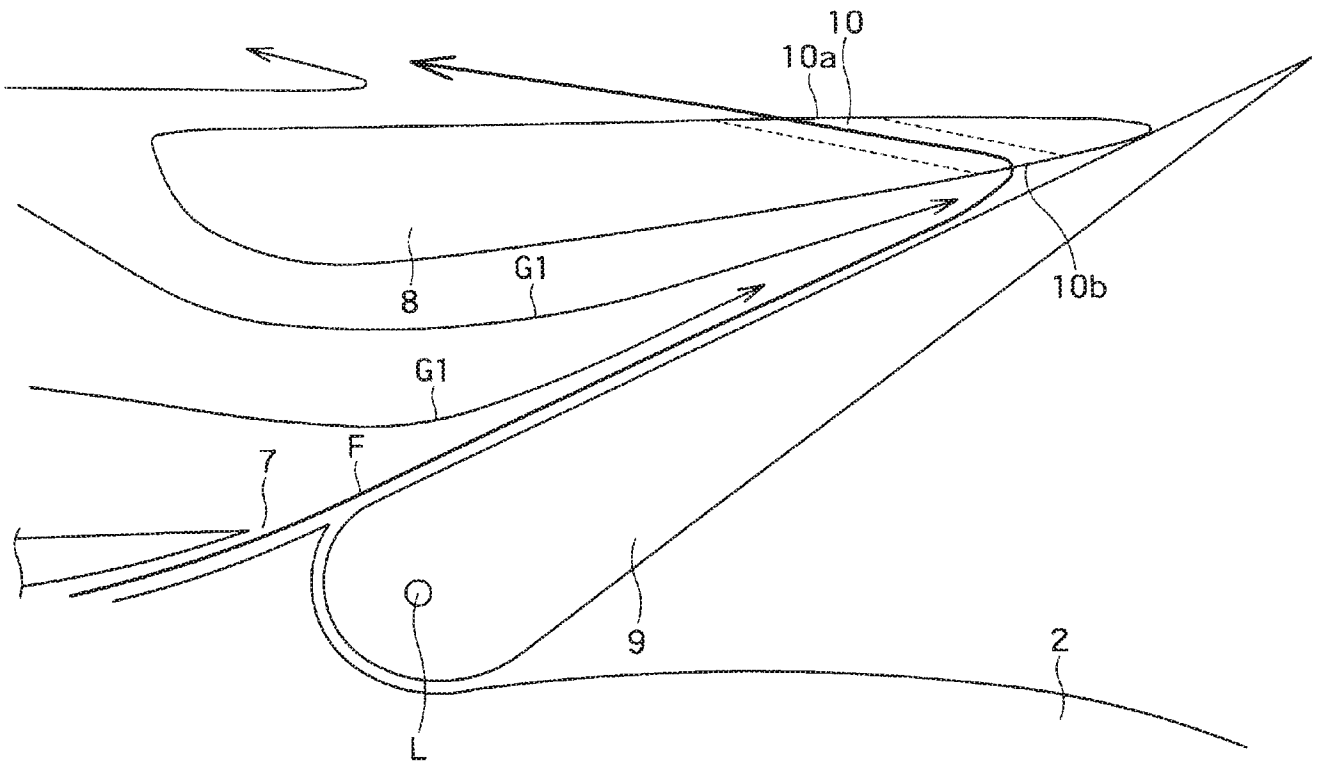
FIG. 9 is an enlarged view showing the diffuser 8, the direction control wings 9, and the path of the water flow in the quick pivotal movement or the backward movement.

On the other hand, the direction control wing 9 on the other side (right in FIG. 8(*a*)) pivots around the axis of rotation L in such a way that the downstream end of the direction control wing 9 comes into contact with a downstream end portion of the diffuser 8, as shown in FIGS. 8(*a*) and 9. The exit (blast port) of the propulsion channel C is therefore closed, and the jet flow F and the entrained flow G1 pass through the entrained flow introducing channel 10 (or cutout 12 of entrained flow introducing groove 11) and exits out of the diffuser 8. Since the opening 10*b* of the entrained flow introducing channel 10 is provided downstream of the opening 10*a*, the jet flow F and the entrained flow G1 flow backward, as shown in FIG. 9. A braking effect is thus provided. Therefore, when the backward blasted flow is produced on one side of the main body 2, the underwater propulsion apparatus 1 can make quick pivotal movement having a small radius of rotation, as shown in FIG. 8(*a*).

<Backward Movement>

In backward movement of the underwater propulsion apparatus 1, the direction control wings 9 pivot around the axis of rotation L in such a way that the downstream ends of the direction control wings 9 come into contact with the downstream end portion of the diffuser 8, as shown in FIGS. 8(*b*) and 9. Since each of the propulsion channels C is therefore closed, and the jet flow F and the entrained flow G1 pass through the entrained flow introducing channels 10 and flow backward, as shown in FIG. 9, the underwater propulsion apparatus 1 moves backward.

As described above, in the underwater propulsion apparatus 1 according to the present embodiment, which is provided with the diffuser 8, the channels of the peripheral flow are narrowed so that the speed thereof increases, and the peripheral flow is drawn to the jet flow. Therefore, according to the present embodiment, the jet flow and the entrained flow drawn by the jet flow can increase the propulsion force.

Further, the jet flow and the entrained flow drawn by the jet flow can ensure propulsion force necessary also in low-speed operation in which the each of impellers 5 rotates at a reduced speed.

Further, the present embodiment, in which the pump-jet-driven method using the impellers 5 is employed, allows suppression of vibration of the main body 2 (low-frequency vibration, in particular) as compared with a propeller-driven method.

Moreover, in the present embodiment, the plurality of direction control wings 9 are attached in an annular shape to the outer surface of the main body 2 and located in positions downstream of the nozzles 7 and close thereto, and the upstream ends of the direction control wings 9 are pivotally supported by the main body 2. The jet flow and the entrained flow drawn by the jet flow then flow along the outer surfaces of the direction control wings 9 in accordance with the Coanda effect. Pivotal movement of the direction control wings 9 allows efficient control of the direction of the jet flow and the entrained flow. Therefore, according to the present embodiment, fine control of the attitude of the underwater propulsion apparatus 1, such as forward movement, pivotal movement, quick pivotal movement, and backward movement, can be performed.

In the underwater propulsion apparatus 1 described above, the diffuser 8 can be omitted. Also in this case, the jet flow and the entrained flow drawn by the jet flow can propel the underwater propulsion apparatus. Further, pivotal movement of the direction control wings 9 allows change in the direction of the jet flow flowing along the outer surfaces of the direction control wings 9 to control the attitude of the underwater propulsion apparatus.

The underwater propulsion apparatus 1 described above may be attached to the stern of a cylindrical hull, as in an embodiment that will be described later, or may be attached to the stern or the bottom of a ship, such as a small boat.

(Underwater Exploration Apparatus)

Figure 10:
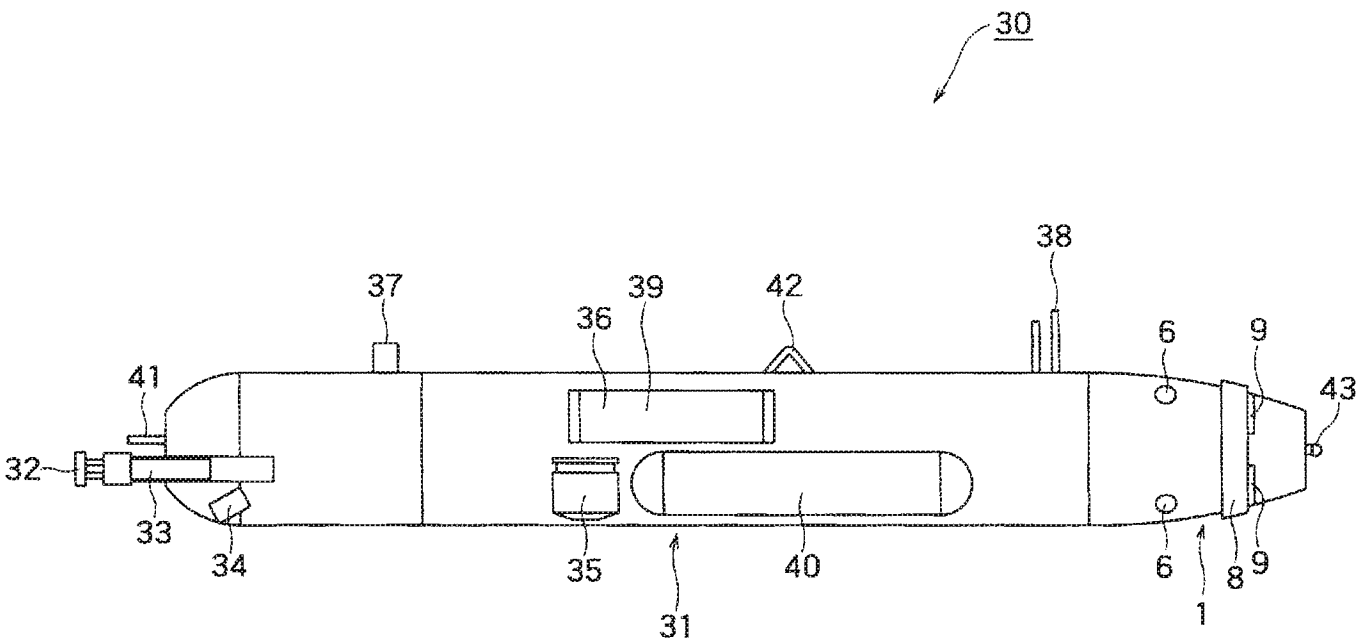
FIG. 10 is a side view of an underwater exploration apparatus 30 according to an embodiment.

An underwater exploration apparatus 30 will next be described with reference to FIG. 10 as an underwater robot (AUV) using the underwater propulsion apparatus described above. FIG. 10 is a side view of the underwater exploration apparatus 30 according to an embodiment.

The underwater exploration apparatus 30 has a torpedo-like shape, and the underwater propulsion apparatus 1 is attached to the stern of the underwater exploration apparatus 30, as shown in FIG. 10. In other words, the underwater exploration apparatus 30 includes a hull 31, which has a conical stern, the at least one pump 3, the diffuser 8, and the plurality of direction control wings 9. The hull 31 is, for example, so sized that the overall length is about 4.5 m and the diameter is about 60 cm.

The hull 31 does not necessarily have a torpedo-like shape or a cylindrical shape and may, for example, have an egg-like shape, a box-like shape, a prismatic shape, a conical shape, a pyramidal shape, or an arbitrary combination thereof. The stern of the hull 31 does not necessarily have a conical shape and may, for example, have a cylindrical shape, a box-like shape, a prismatic shape, or a pyramidal shape.

The hull 31 accommodates not only a variety of sensors and measurement apparatus according to observation purposes and targets but also a controller, a battery, and other components.

A Doppler velocity log (DVL) 35, a gyro compass 36, and a depth meter (not shown) are provided as the variety of sensors and measuring apparatus. A microstructure sensor 32, a plankton camera 33 for observing planktons, and a multi-beam sonar 34 may be provided at the bow of the hull 31.

The controller 39 includes an electronic system, such as a computer, and controls the variety of sensors and measuring apparatus. The controller 39 may further control the number of revolutions of the pumps 3 (impellers 5) and control the angle of each of the direction control wings 9.

A battery system 40 includes a battery, such as a secondary cell (lithium ion cell, for example) or a fuel cell, and a battery management unit (BNU). The variety of sensors and measuring apparatus, a communication apparatus, the controller, and other components operate with electricity supplied from the battery.

An acoustic communication transducer 37 and a wireless communication antenna 38 may be provided as the communication apparatus in the hull 31. The wireless communication antenna 38 can also receive a GPS signal.

A nose hoist point 41, which is used to lift the underwater exploration apparatus 30, may be provided at the bow of the hull 31, a top-middle hoist point 42 may be provided on an upper central portion of the hull 31, and a towing eye 43, which is used to tow sensors and other components may be provided at the stern of the hull 31.

In the underwater exploration apparatus 30 according to the present embodiment, providing the diffuser 8 allows the propulsion force to be increased and propulsion force necessary in low-speed operation to be ensured, as mentioned in the description of the underwater propulsion apparatus 1.

Since the water-jet-driven method using the impellers 5 is employed, the vibration of the hull 31 (low-frequency vibration, in particular) can be suppressed. Since the low-frequency vibration of the hull 31 can be suppressed, a sensor highly sensitive to low-frequency vibration (such as sensor for measuring agitation) can be used. Further, since no helical water flow is produced behind the hull 31 because no propeller is used, a sensor can be towed via the towing eye 43. Moreover, since no fins for stabilizing the attitude of the hull need to be provided at the tail portion of the hull, a situation in which the hull 31 is caught, for example, by underwater algae can be avoided.

Further, causing the plurality of direction control wings 9 to pivot allows fine control of the attitude of the hull 31, such as forward movement, backward movement, pivotal movement, and quick pivotal movement, to be performed, as mentioned in the description of the underwater propulsion apparatus 1.

In the present embodiment, one underwater propulsion apparatus is attached to the hull, but not necessarily in the present invention, and a plurality of underwater propulsion apparatus may be attached to the hull. For example, two underwater propulsion apparatus 1 may be provided on the right and left sides of a waist portion of the hull.

In the underwater exploration apparatus 30 described above, the diffuser 8 can be omitted. Also in this case, the jet flow and the entrained flow drawn by the jet flow can propel the underwater exploration apparatus. Further, the attitude of the underwater exploration apparatus can be controlled by causing the direction control wings 9 to pivot so that the direction of the jet flow flowing along the outer surfaces of the direction control wings 9 is changed.

A person skilled in the art may conceive of additional effects of the present invention and a variety of variations thereof on the basis of the above description. Aspects of the present invention are not limited to the embodiments described above. A variety of additions, changes, and partial omissions are possible to the extent that they do not depart from the conceptual idea and sprit of the present invention derived from the contents set forth in the claims and equivalents of the contents.

REFERENCE SIGNS LIST

1 Underwater propulsion apparatus
2 Main body
3 Pump
4 Channel
5 Impeller
6 Inlet
7 Nozzle
8 Diffuser
8*a* Outer surface
8*b* Inner surface
9 Direction control wing
10 Entrained flow introducing channel
10*a*, 10*b* Opening
11 Entrained flow introducing groove
12 Cutout
13 Entrained flow introducing channel
30 Underwater exploration apparatus
31 Hull
32 Microstructure sensor
33 Plankton camera
34 Multi-beam sonar
35 Doppler Velocity Log (Velocity sensor)
36 Gyro compass
37 Acoustic communication transducer
38 Wireless communication antenna
39 Controller
40 Battery system
41, 42 Hoist point
43 Towing eye
C Propulsion channel
F Jet flow
G1, G2 Entrained flow
L Axis of rotation (of direction control wing 9)
M Center axis (of main body 2)

The invention claimed is:

1. An underwater propulsion apparatus comprising:
a main body;
at least one pump having a channel and an impeller provided in the channel, the channel having an inlet in an outer circumferential surface of the main body and a nozzle on a side downstream of the inlet and in a tail portion of the main body; and
a plurality of direction control wings attached to an outer surface of the main body and located in positions downstream of the nozzle and close thereto, each of the plurality of direction control wings having an upstream end pivotally supported by the main body,
wherein the nozzle is configured to blast jet flow along a surface of at least one of the direction control wings,
the underwater propulsion apparatus further comprising a diffuser attached to the main body so as to surround an outer circumference of the nozzle.

2. The underwater propulsion apparatus according to claim 1, wherein the diffuser is provided with a first entrained flow introducing channel that passes through the diffuser and introduces water flow flowing along an outer side of the diffuser into a propulsion channel sandwiched between the diffuser and the direction control wings.

3. The underwater propulsion apparatus according to claim 1, wherein an outer surface of a downstream end portion of the diffuser is provided with a plurality of first entrained flow introducing grooves that extend from an upstream side toward a downstream side and have a depth that increases with distance toward the downstream side.

4. The underwater propulsion apparatus according to claim 1, wherein an edge portion upstream of the nozzle is provided with a second entrained flow introducing channel that passes through the edge portion and introduces water flow flowing along an outer side of the main body into the channel.

5. The underwater propulsion apparatus according to claim 1, wherein an outer surface of an edge portion upstream of the nozzle is provided with a plurality of second entrained flow introducing grooves that extend from an upstream side toward a downstream side and have a depth that increases with distance toward the downstream side.

6. The underwater propulsion apparatus according to claim 1, wherein the tail portion of the main body has a conical shape with a head portion truncated.

7. An underwater exploration apparatus comprising:
a hull having a stern;
at least one pump having a channel and an impeller provided in the channel, the channel having an inlet in an outer circumferential surface of the hull and a nozzle on a side downstream of the inlet and in the stern; and
a plurality of direction control wings attached to an outer surface of the hull and located in positions downstream of the nozzle and close thereto, each of the plurality of direction control wings having an upstream end pivotally supported by the hull,
wherein the nozzle is configured to blast jet flow along a surface of at least one of the plurality of direction control wings,
the underwater exploration apparatus further comprising a diffuser attached to the hull so as to surround an outer circumference of the nozzle.

8. The underwater exploration apparatus according to claim 7, wherein the diffuser is provided with an entrained flow introducing channel that passes through the diffuser and introduces water flow flowing along an outer side of the diffuser into a propulsion channel sandwiched between the diffuser and the direction control wings.

9. The underwater exploration apparatus according to claim 7, wherein an outer surface of a downstream end portion of the diffuser is provided with a plurality of entrained flow introducing grooves that extend from an upstream side toward a downstream side and have a depth that increases with distance toward the downstream side.

10. The underwater exploration apparatus according to claim 7, wherein an edge portion upstream of the nozzle is provided with a second entrained flow introducing channel that passes through the edge portion and introduces water flow flowing along an outer side of the hull into the channel and in a portion close to the nozzle.

11. The underwater exploration apparatus according to claim 7, wherein an outer surface of an edge portion upstream of the nozzle is provided with a plurality of second entrained flow introducing grooves that extend from an upstream side toward a downstream side and have a depth that increases with distance toward the downstream side.

12. The underwater exploration apparatus according to claim 7, wherein the stern of the hull has a conical shape with a head portion truncated.

* * * * *